US006193287B1

(12) United States Patent
Li et al.

(10) Patent No.: US 6,193,287 B1
(45) Date of Patent: Feb. 27, 2001

(54) ELECTRONIC CHASSIS DOOR LOCKING APPARATUS

(75) Inventors: Hong Li, Carol Stream; Daniel J. Lecinski; Kenneth S. Laughlin, both of Arlington Heights, all of IL (US)

(73) Assignee: 3COM Corporation, Rolling Meadows, IL (US)

( * ) Notice: Subject to any disclaimer, the term of this patent is extended or adjusted under 35 U.S.C. 154(b) by 0 days.

(21) Appl. No.: 09/318,424

(22) Filed: May 25, 1999

(51) Int. Cl.[7] ..... E05C 1/06; E05C 1/12; E05C 7/00; E05C 9/10

(52) U.S. Cl. ..... 292/37; 292/169.14; 292/DIG. 7

(58) Field of Search ..... 292/159, 169.14, 292/140, DIG. 7, 175, 203, 37, 197, 194, 240, 202; 49/503

(56) References Cited

U.S. PATENT DOCUMENTS

| | | | | |
|---|---|---|---|---|
| 1,223,455 | * | 4/1917 | Weiss | 292/175 |
| 2,516,550 | * | 7/1950 | Cheney | 292/175 |
| 2,650,124 | * | 8/1953 | Olson | 292/194 |
| 3,519,299 | * | 7/1970 | Godwin | 292/175 |
| 4,063,436 | * | 12/1977 | Miller | 292/175 |
| 4,249,760 | * | 2/1981 | Conley | 292/197 |
| 4,475,311 | * | 10/1984 | Gibson | 292/175 |
| 4,586,736 | * | 5/1986 | Dougherty | 292/202 |
| 5,064,104 | * | 11/1991 | Milton et al. | 222/306 |
| 5,234,236 | * | 8/1993 | Gromotka | 292/197 |
| 5,878,608 | * | 3/1999 | Alyanakian | 292/175 |
| 5,927,765 | * | 7/1999 | Austin et al. | 292/194 |
| 5,927,766 | * | 7/1999 | Rosen | 292/101 |

OTHER PUBLICATIONS

An Advertisment page entitled "Single–hole Mount" (Author unknown, undated, 1 pg.).

An Advertisement page entitled "disc tumbler cylinder cam locks" (Author STOCKLOCKS®, undated, p. 12).

A photocopy of a "Quarter—Turn Lock" (Author unknown, undated, 1 pg.).

* cited by examiner

*Primary Examiner*—Lynne H. Browne
*Assistant Examiner*—John B. Walsh
(74) *Attorney, Agent, or Firm*—Baniak Pine & Gannon

(57) ABSTRACT

An electronic chassis door locking apparatus includes an electronic chassis door and a locking assembly. The electronic chassis door includes a recessed region formed therein. The recessed region is positioned adjacent a latch. The latch is operably attached to the electronic chassis door. The locking assembly is received in the recessed region, and includes a lock screw and a lock cam. The lock cam includes a first opening and an engaging portion. The engaging portion allows for engagement with the latch.

15 Claims, 4 Drawing Sheets

10
12
14
16
18
20
A
C
54
58

ELECTRONIC CHASSIS DOOR LOCKING APPARATUS

FIELD OF THE INVENTION

The present invention relates to locking devices, and, in particular, locking devices capable of locking and unlocking an electronic chassis door within a quarter-turn motion, and being of both a low profile and a heavy-duty nature.

BACKGROUND OF THE INVENTION

Locking devices used to secure items are commonplace in today's society. Locking devices may be installed on the doors of cabinets and the like in an effort to prevent unauthorized usage of the items inside the spaces. Additionally, these conventional locking devices may be installed in, for example, the chassis of electronic cabinets. Typically, these locking devices include a locking device, consisting usually of a lock cam and a lock screw, mounted within the chassis door of an electronic cabinet. Because of these features, the overall depth of the door of the cabinet is ultimately increased. The amount by which these locking devices increase the overall depth of the chassis door has been shown to be problematic, especially in regards to situations in which space is at a premium, such as in laboratories, clean rooms, communications rooms, etc. Additionally, these locking devices may fail during extreme vibration, such as during an earthquake, a move, or other similar movement. Accordingly, it would be desirable to have a locking apparatus that would resolve the above problems and still be simple and efficient to operate.

SUMMARY OF THE INVENTION

One aspect of the invention provides an electronic chassis door locking apparatus. The apparatus includes an electronic chassis door and a locking assembly. The electronic chassis door includes a recessed region, formed therein, which is positioned adjacent to a latch. The recessed region is preferably of a bowl-shaped divot impressed within the electronic chassis door. The recessed region may further include a guide region. The electronic chassis door may further include a first dimple region, formed adjacent to the recessed region and the latch, and a second dimple region, formed adjacent to the recessed region. The first dimple region and the second dimple region may preferably be oriented at 90 degrees, with respect to the recessed region. The locking assembly is received in the recessed region, and includes a lock screw and a lock cam. The locking assembly preferably is rotatable 90 degrees, between a locked position and an unlocked position. The locking assembly may further include a screw to attach the lock cam to the lock screw. The locking assembly may also further include a second washer, received on the screw. The lock screw may further include a head portion and a stem portion. The head portion preferably receives an Allen-head type screwdriver. The stem portion and the head portion are preferably integral with respect to each other. The lock cam includes a first opening and an engaging portion, which allows for engagement with the latch and includes a second opening. The first opening of the lock cam preferably receives the stem portion of the lock screw. The lock cam may further include a guide tab, which preferably extends into the first opening of the lock cam, and preferably is received in the guide region of the recessed region. The engaging portion may further include a beveled surface to interface with the first and second dimples of the electronic chassis door. The second opening of the engaging portion preferably receives either the first dimple or the second dimple of the electronic chassis door, and may also include a beveled surface to interface with the first and second dimples of the electronic chassis door. The total overall depth of the apparatus is preferably less than 0.500 inches.

A further aspect of the invention provides a method of operating an electronic chassis door locking apparatus. An electronic chassis door and a locking assembly is provided. The electronic chassis door includes a recessed region, formed therein, which is positioned adjacent to the latch. The electronic chassis door may further include a first dimple region, formed adjacent to the recessed region and the latch, and a second dimple region, formed adjacent to the recessed region. The locking assembly is received in the recessed region, and includes a lock screw and a lock cam. The lock cam includes a first opening and an engaging portion. The engaging portion preferably includes a second opening. The lock screw is rotated in a first direction to engage the lock cam with the latch, and preferably engages the second opening with the first dimple region. The lock screw is then rotated in a second direction to disengage the lock cam from the latch, and preferably the second opening with the second dimple region.

The invention provides the foregoing and other features, and the advantages of the invention will become further apparent from the following detailed description of the presently preferred embodiments, read in conjunction with the accompanying drawings. The detailed description and drawings are merely illustrative of the invention and do not limit the scope of the invention, which is defined by the appended claims and the equivalents thereof.

DETAILED DESCRIPTION OF THE PRESENTLY PREFERRED EMBODIMENTS

Figure 1A:
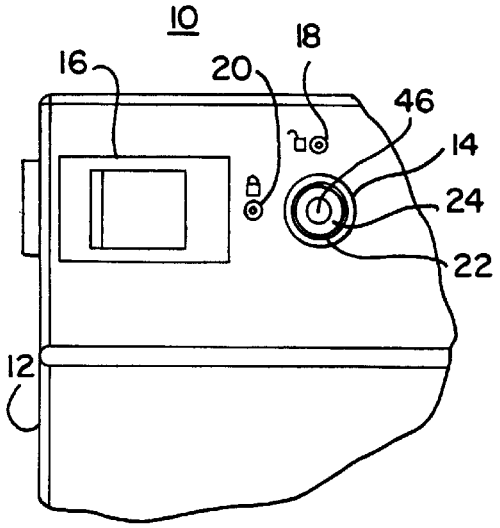
FIG. 1*a* is a front elevated view of a preferred embodiment of an electronic chassis door locking apparatus, made in accordance with the invention.
Figure 1B:
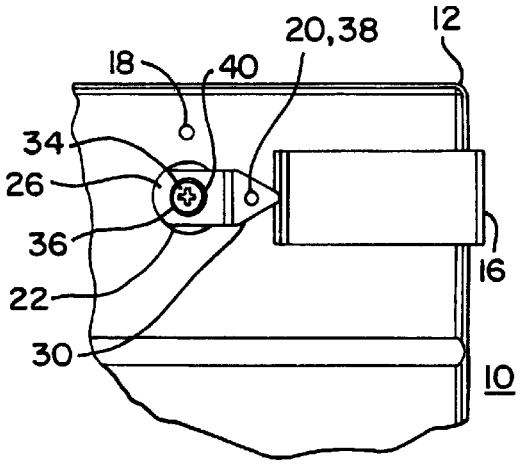
FIG. 1*b* is a back elevated view of the embodiment of FIG. 1*a;*
Figure 1C:
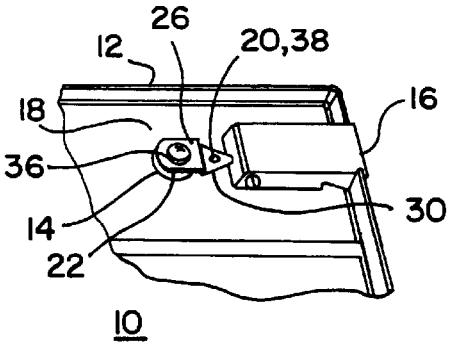
FIG. 1*c* is a back perspective view of the embodiment of FIG. 1*a*, showing an axis through the locking assembly.

Referring to FIGS. 1*a–d*, reference numeral 10 represents a preferred embodiment of an electronic chassis door locking apparatus, which comprises an electronic chassis door 12 including a recessed region 14 formed therein, and a locking assembly 22 received in the recessed region 14. As shown in FIGS. 1*a–d*, the recessed region 14 is positioned adjacent a latch 16 which is operably attached to the electronic chassis door 12. The locking assembly 22 includes a lock screw 24 and a lock cam 26. The lock screw 24 is received in the recessed region 14 of the electronic chassis door 12. The lock cam includes a first opening 28 formed therein to receive the lock screw 24. The lock cam also includes an engaging portion 30 to allow engagement with the latch 16. The engaging portion 30 interacts with the latch 16 to lock or unlock the electronic chassis door 12. When the electronic chassis door 12 is in a locked position, the engaging portion 30 of the lock cam 26 is in contact with the latch 16, preventing the latch 16 from displacing, and thus preventing the electronic chassis door 12 from opening.

The electronic chassis door 12 may preferably be made of any suitable rigid material, such as, for example, sheet metal, aluminum, stainless steel, etc. The recessed region 14, which is formed in the electronic chassis door 12, is designed to preferably reduce the total overall depth of the electronic chassis door locking apparatus 10 to less than 0.500 inches. The latch 16, which is preferably a spring-loaded latch, is preferably biased to keep the electronic chassis door 12 in a closed position. The latch 16 may preferably, for example, be attached to the electronic chassis door 12 by being positioned into an opening within the electronic chassis door 12.

Figure 1D:
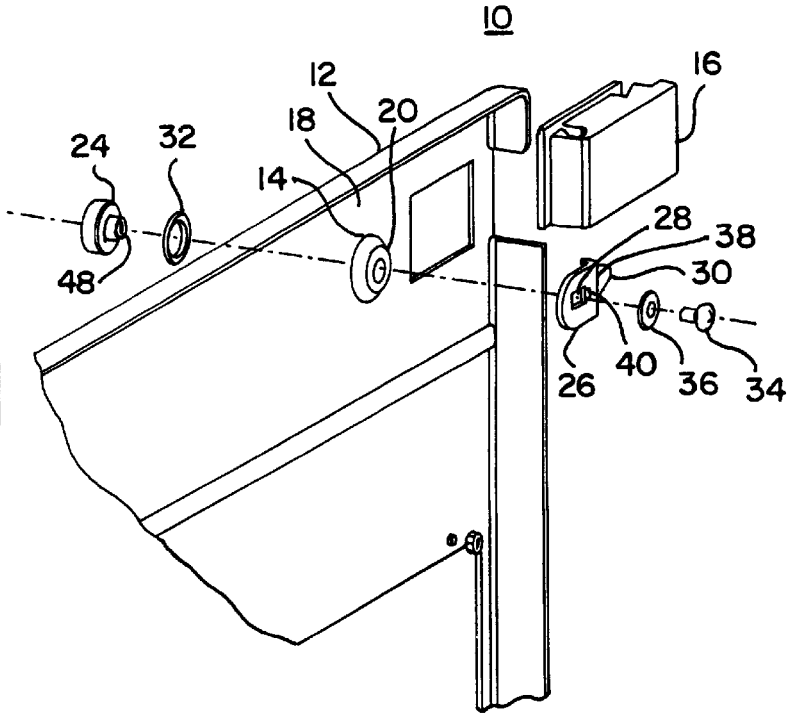
FIG. 1*d* is an exploded back perspective view of the embodiment of FIG. 1*c;*

As shown in FIG. 1*d*, first dimple region 18 and second dimple region 20 are preferably formed in the electronic chassis door 12. The dimple regions 18, 20 are indented into the electronic chassis door 12, and extend outward from a back surface of the electronic chassis door 12. Preferably, the dimple regions 18, 20 are oriented at a 90 degree angle with respect to each other. This allows the electronic chassis door locking apparatus 10 to preferably maintain a quarter-turn lock rotation, as the presence of the dimple regions 18, 20 helps to prevent the electronic chassis door locking apparatus to rotate more than 90 degrees. Indicators may preferably be inscribed on a front surface of the electronic chassis door 12 adjacent to the dimple regions 18, 20 to aid a user in locking and unlocking the electronic chassis door 12. Another purpose of the dimple regions 18, 20 is to preferably provide a positive locking feature of the electronic chassis door locking apparatus 10. In other words, when the electronic chassis door locking apparatus 10 is maintained in a locked position, it will not inadvertently slip out of the locked position when subjected to vibrations from, for example, earthquakes. Similarly, the same features assure the electronic chassis door locking apparatus 10 will remain in an unlocked position.

Finally, also shown in FIG. 1*d* are features of the preferred embodiment of the locking assembly 22. A first washer 32, preferably received on the lock screw 24, is shown. A screw 34 is also shown. The screw 34 is preferably used to secure the lock cam 26 to the lock screw 24. There is also shown a second washer 36, which is preferably received on the screw 32.

Figure 2A:
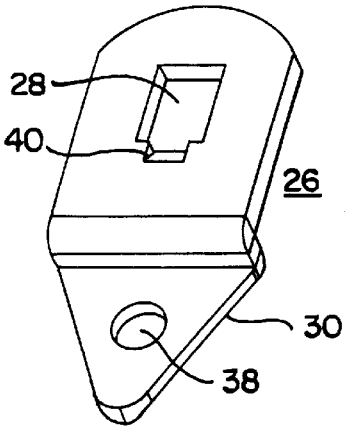
FIG. 2*a* is a perspective view of a preferred embodiment of a lock cam of the electronic chassis door locking apparatus, made in accordance with the invention.
Figure 2B:
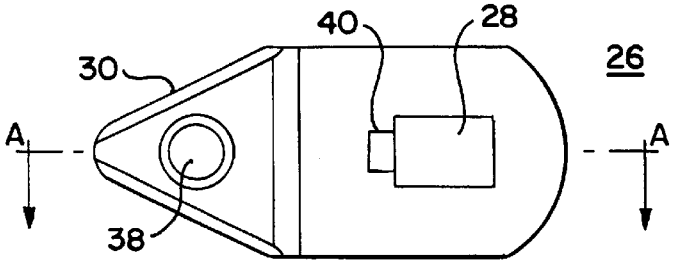
FIG. 2*b* is a top view of the embodiment of FIG. 2*a;*
Figure 2C:
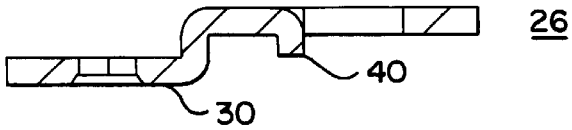
FIG. 2*c* is a sectional view, taken through line A—A of FIG. 2*b;*

The lock cam 26 is shown in more detail in FIGS. 2*a–c*. As shown in FIG. 2*a*, the engaging portion 30 preferably includes a second opening 38. The second opening 38 is preferably used, in conjunction with the dimple regions 18, 20, to bias the locking assembly 22 in either a locked or an unlocked position. This biasing is achieved by positioning the second opening 38 of the lock cam 26 over either the first dimple region 18 or the second dimple region 20. This can be done by rotating the locking assembly 22 from the locked position to the unlocked position, or vice versa. Because the dimple regions 18, 20 are indented into the electronic chassis door 12, the dimple regions are received in the second opening 38 of the lock cam 26 when the second opening 38 of the lock cam 26 passes over either of the dimple regions 18, 20. When this occurs, the lock cam 26 appears to "snap into place", alerting the user that the electronic chassis door locking apparatus 10 is fully locked or unlocked.

Additionally, the reception of the dimple regions 18, 20 within the lock cam 26 aids in the electronic chassis door locking apparatus 10 in not coming unlocked without the positive assistance of the user. This is the positive locking feature of the electronic chassis door locking apparatus 10, and is achieved because, in order for the lock cam 26 to be displaced from either of the dimple regions 18, 20, the user must apply approximately 3–5 in-lbs. of torque to the electronic chassis door locking apparatus 10. Conversely, the same amount of torque is required to initially position the lock cam 26 over the dimple regions 18, 20.

Preferably, the edge of the second opening 38 of the lock cam 26 is smoothed over, such as by beveling or by any other similar means. The smoothing over of the edge of the second opening 28 is best shown with reference to FIG. 2*b*. The purpose of smoothing over the edge of the second opening 38 is to allow for ease of interface with the dimple regions 18, 20. Using the same rationale, the edge of the engaging portion 30 is also smoothed over in the same manner, as also shown in FIG. 2*b*.

Also shown in FIG. 2*c* is a guide tab 40. The guide tab 40 of the lock cam 26 preferably projects in a downward direction from the lock cam 26, and is directed into the recessed region 14 of the electronic chassis door 12.

Figure 3A:
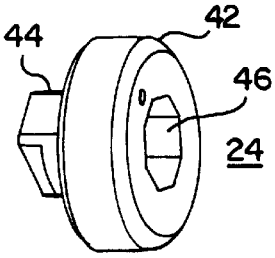
FIG. 3*a* is a perspective view of a preferred embodiment of a lock screw of the electronic chassis door locking apparatus, made in accordance with the invention.
Figure 3C:
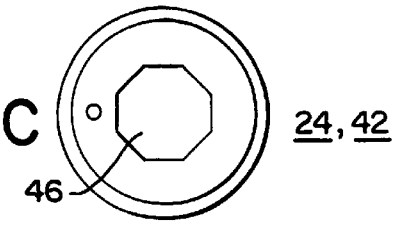
FIG. 3*c* is a top view of the embodiment of FIG. 3*a;*
Figure 3B:
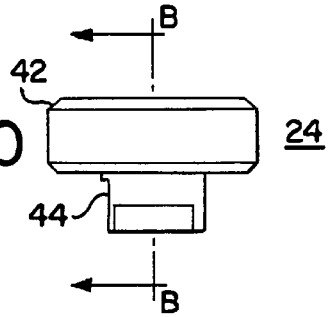
FIG. 3*b* is a side view of the embodiment of FIG. 3*a;*
Figure 3E:
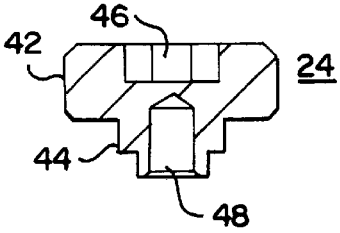
FIG. 3*e* is a sectional view, taken through line B—B of FIG. 3*b;*
Figure 3D:
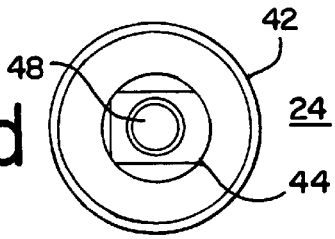
FIG. 3*d* is a bottom view of the embodiment of FIG. 3*a;*

The lock screw 28 is shown in more detail in FIGS. 3*a–e*. Referring to FIG. 3*a*, the lock screw 24 includes head portion 42 and stem portion 44. The head portion 42 and the stem portion 44 are preferably integral with respect to each other, but may be made of separate parts. Additionally, the head portion 42 contains a head opening 46, as shown in FIGS. 3*a*, 3*c* and 3*e*, which is preferably adapted to receive and Allen-headed type screwdriver. The head opening 46 can also be adapted to receive any similar type of mechanical device providing for the rotation of the lock screw 24. The stem portion 44 of the lock screw 24 is preferably shaped to fit within the second opening 24 of the lock cam 26, as is shown in FIGS. 3*a* and 3*e*. Conversely, the second opening 24 of the lock cam 26 is preferably shaped to provide a fit with the stem portion 44 of the lock screw 24. Additionally, the stem portion 44 of the lock screw 24 preferably contains a stem opening 48, shown in FIG. 3*e*, which is adapted for receiving the screw 32 of the locking assembly 22.

Figure 4B:
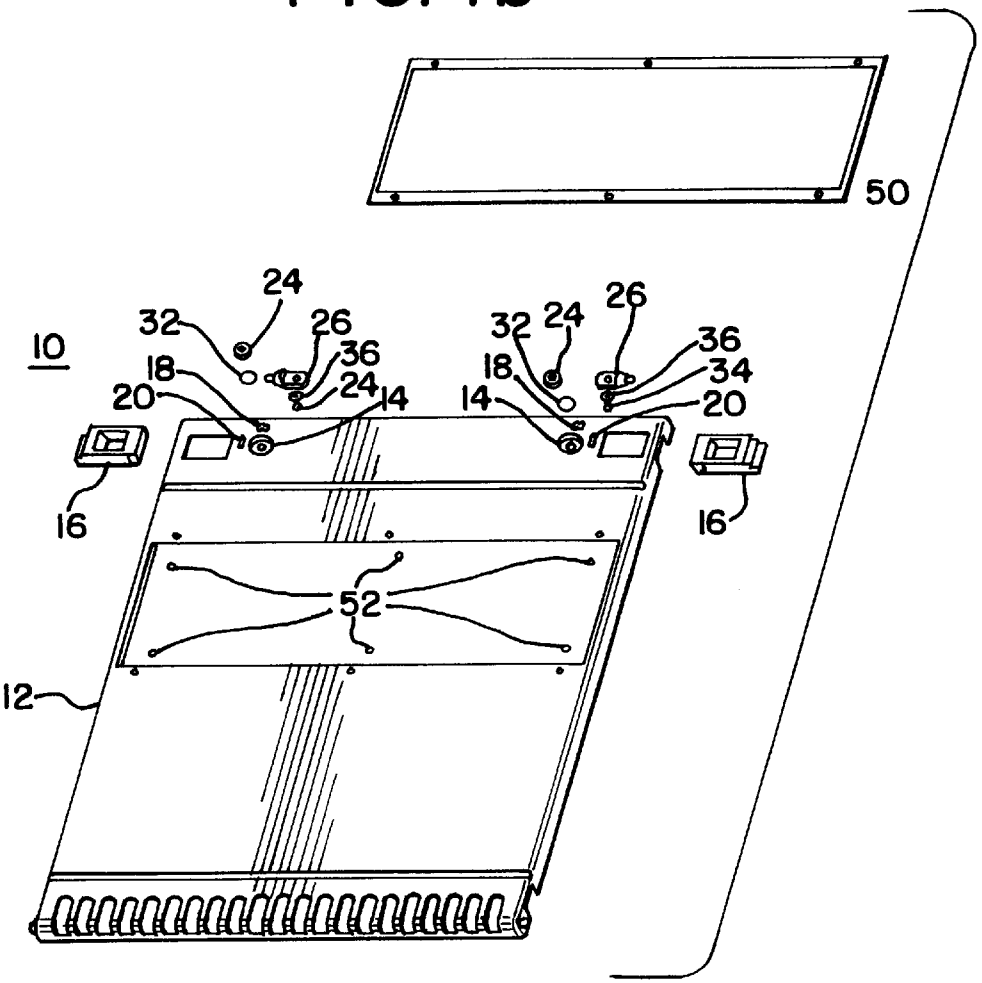
FIG. 4*b* is an exploded front perspective view of the embodiment of FIG. 4*a;*
Figure 4A:
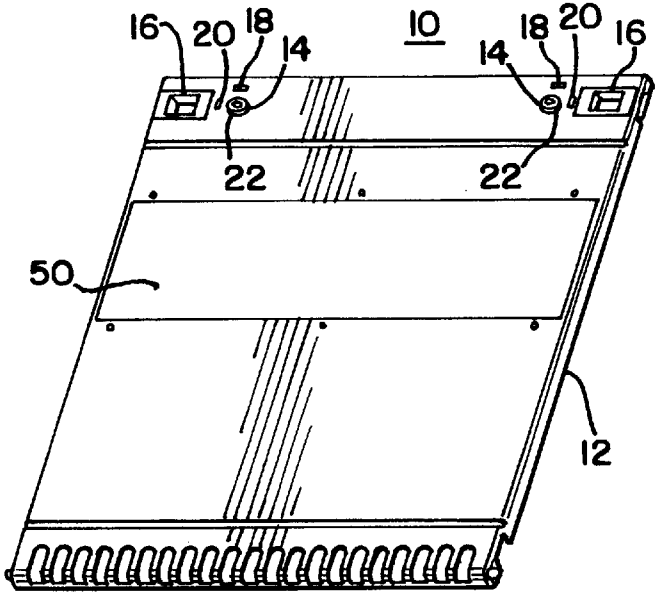
FIG. 4*a* is a front perspective view of a preferred embodiment of an electronic chassis door locking apparatus, made in accordance with the invention, and shown with a window on the electronic chassis door.

In FIGS. 4*a–b*, the electronic chassis door 12 is shown with a front window 50 disposed within the electronic chassis door 12. Preferably, the front window 50, which may be of a transparent material such as, for example, clear plastic, allows the user to view the contents of the electronic chassis. FIG. 4*a* shows the electronic chassis door locking apparatus 10 with both the locking assembly 22 and the front window 50 attached to the electronic chassis door 12. In FIG. 4*b*, the front window 50 is shown detached from the electronic chassis door 12. Also shown in FIG. 4*b* are a plurality of lens screws 52, which preferably attach the front window 50 to the electronic chassis door. In FIGS. 5*a–e*, the electronic chassis door 12 is shown with the front window 50 taking the form of sheet metal. Thus, the front window 50 may be made of a number of materials, dependent upon the particular desires of the user.

Figures 5A, 5B, 5C, 5D, 5E:
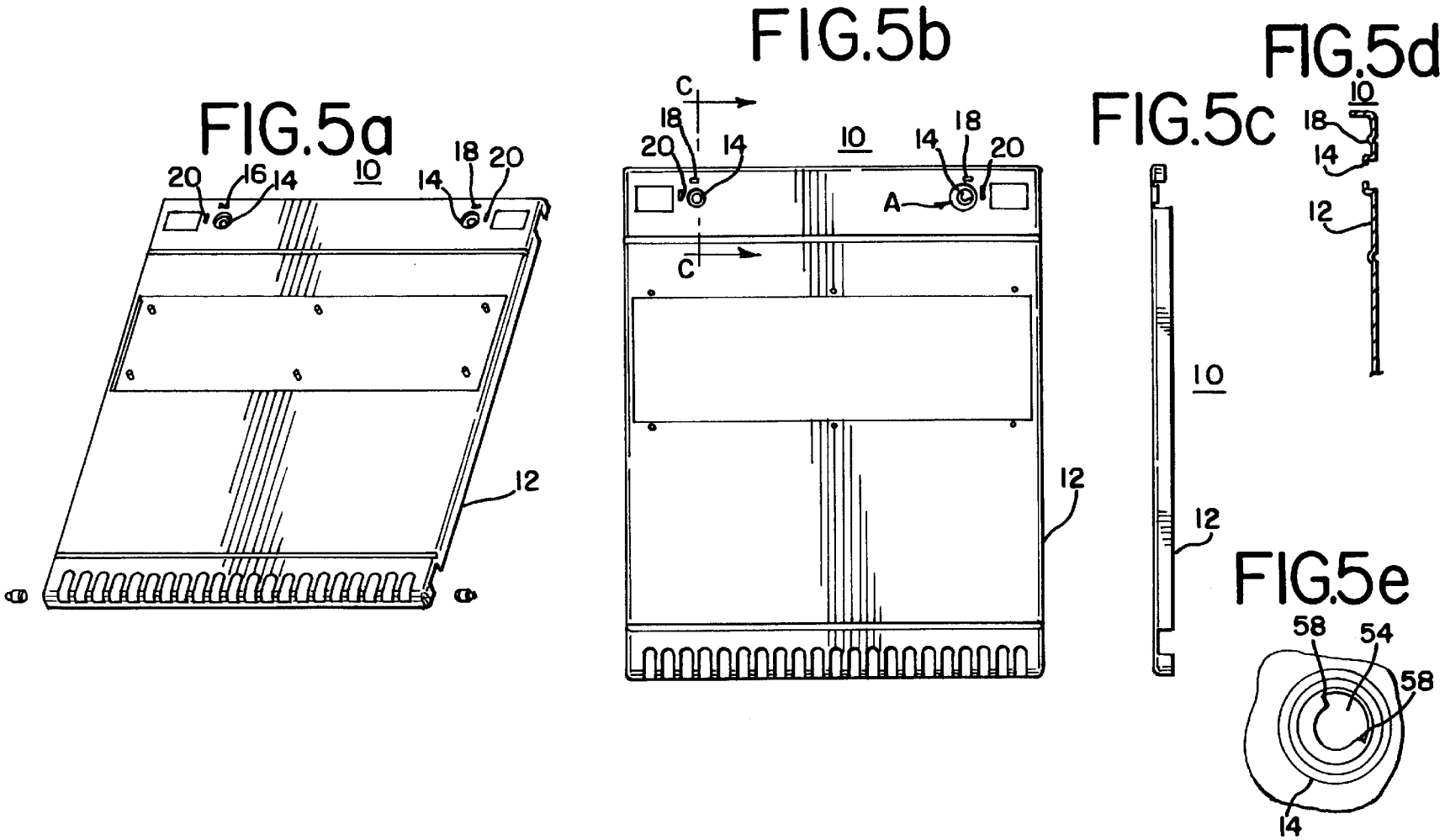
FIG. 5*a* is a front perspective view of a preferred embodiment of an electronic chassis door, made in accordance with the invention, and shown without the locking apparatus and the spring-loaded latch.
FIG. 5*b* is a front elevated view of the embodiment of FIG. 5*a;*
FIG. 5*c* is a side view of the embodiment of FIG. 5*b;*
FIG. 5*d* is a sectional view, taken through line C—C of FIG. 5*b*.
FIG. 5*e* is an enlarged view of the region within circle A of FIG. 5*b*.

FIG. 5*d* shows, in more detail, a cutout view of the preferred dimensions of the recessed region 14 and of the first dimple region 18. Preferably, the recessed region 14 takes the shape of a bowl-shaped divot, impressed within the electronic chassis door 12. In this way, the lock screw 24 may be received within the recessed region 14, thus reducing the overall depth of the electronic chassis door locking apparatus 10. Additionally, the second dimple region 20, which is substantially similar in shape to the first dimple region 18, is shown as an indentation within the electronic chassis door 12.

The recessed region 14 is shown, in more detail, in FIG. 5*e*. Within the recessed region 14, there is shown a guide region 54. The guide region 54 of the recessed region 14 receives the guide tab 40 of the lock cam 26 of the locking assembly 22. When the locking assembly 22 is rotated from a locked to an unlocked position, or vice versa, the guide tab 40 comes into contact with the edges of the guide region, referenced as numeral 58. In doing so, the edges prevent the locking assembly 22 from extending beyond the preferred 90 degrees range by prohibiting the guide tab 40 from moving within the recessed region past a preferred predetermined point.

The specifics of the structure of a preferred embodiment of the electronic chassis door locking apparatus 10 having been disclosed, attention will now be directed to operation of the electronic chassis door locking apparatus 10. With reference to FIG. 1*d*, the electronic chassis door locking apparatus 10 may be assembled as follows: The lock screw 24 is inserted into the recessed region 14 of the electronic chassis door 12. The lock cam 26 is then placed over the lock screw 24, such that the first opening 28 of the lock cam receives the lock screw 24. The latch 16 may then be attached to the electronic chassis door 12. At this point, the engaging portion 30 is positioned such that it may interact with the latch 16, preventing movement of the latch 16. This is considered the locked position of the electronic chassis door locking apparatus 10. When the locking assembly is preferably rotated 90 degrees, which may be realized by insertion of an Allen-headed type screwdriver into the lock screw 24, the engaging portion 30 is not positioned to interact with the latch 16. At this point, since movement of the latch 16 is not proscribed, the electronic chassis door locking apparatus 10 is in an unlocked position. As a result, the latch 16 may be displaced, and the electronic chassis door 12 may be opened.

Additionally, concurrent with the rotation of the locking assembly 22, the lock cam 26 is preferably displaced from one of the dimple regions 18, 20 to the other. In doing so, the lock cam 26 becomes positioned on one of the dimple regions 18, 20. As a result, the lock cam 26 "snaps" into place, thus preventing the inadvertent movement of the locking assembly 22. Further movement of the lock cam 26 preferably requires the application of about 3–5 in-lbs. of torque to the locking assembly 22 to move the lock cam 26 from one of the dimple regions 18, 20 to the other.

While the embodiments of the present invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. An electronic chassis door locking apparatus, comprising:

an electronic chassis door including a recessed region formed therein, the recessed region positioned adjacent a latch operatively attached to the electronic chassis door, and a locking assembly received in the recessed region, the locking assembly including a lock screw and a lock cam, the lock cam including a first opening formed therein to receive the lock screw and an engaging portion to allow engagement with the latch, wherein the lock cam further includes a guide tab extending into the first opening of the lock cam, and wherein the recessed region further includes a guide region for receiving the guide tab of the lock cam.

2. The electronic chassis door locking apparatus of claim 1, wherein the total overall depth of the electronic chassis door locking apparatus is less than 0.500 inches.

3. The electronic chassis door locking apparatus of claim 1, wherein the lock screw further includes a head portion and a stem portion.

4. The electronic chassis door locking apparatus of claim 1, wherein the stem portion and the head portion of the lock screw are integral with respect to each other.

5. The electronic chassis door locking apparatus of claim 4, wherein the head portion of the lock screw receives an Allen-headed type screwdriver.

6. The electronic chassis door locking apparatus of claim 5, wherein the recessed region is of a bowl-shaped divot, impressed within the electronic chassis door.

7. The electronic chassis door locking apparatus of claim 6, wherein the locking assembly is rotatable 90 degrees between a locked position and an unlocked position.

8. The electronic chassis door locking apparatus of claim 3, wherein the locking assembly further includes a screw to attach the lock cam to the lock screw.

9. The electronic chassis door locking apparatus of claim 8, wherein the locking assembly further includes a first washer received on the lock screw, and a second washer received on the screw of the locking assembly.

10. An electronic chassis door locking apparatus, comprising:

an electronic chassis door including a recessed region formed therein, the recessed region positioned adjacent a latch operatively attached to the electronic chassis door, and a locking assembly received in the recessed region, the locking assembly including a lock screw and a lock cam, the lock cam including a first opening formed therein to receive the lock screw and an engaging portion to allow engagement with the latch, the electronic chassis door further including a first raised dimple region formed between the recessed region and the latch, the electronic chassis door further including a second raised dimple region formed adjacent to the recessed region wherein the engaging portion further includes a second opening to receive either the first or second raised dimple regions of the electronic chassis door.

11. The electronic chassis door locking apparatus of claim 10, wherein the engaging portion includes a beveled surface to interface with the first and second raised dimple regions of the electronic chassis door.

12. The electronic chassis door locking apparatus of claim 11, wherein the second opening of the engaging portion includes a beveled surface to interface with the first and second raised dimple regions of the electronic chassis door.

13. The electronic chassis door locking apparatus of claim 12, wherein the first and second raised dimple regions of the electronic chassis door are oriented at approximately 90 degrees with respect to the recessed region.

14. An electronic chassis door locking apparatus, comprising:

an electronic chassis door including a recessed region formed therein, the recessed region positioned adjacent a latch operatively attached to the electronic chassis door, and a locking assembly received in the recessed region, the locking assembly including a lock screw and a lock cam, the lock cam including a first opening formed therein to receive the lock screw and an engaging portion to allow engagement with the latch, the lock cam further including a guide tab extending into the first opening of the lock cam, the recessed region further including a guide region for receiving the guide tab of the lock cam, the electronic chassis door further including a first dimple region formed adjacent to the recessed region and the latch, the electronic chassis door further including a second dimple region formed adjacent to the recessed region, the lock screw further including a head portion and a stem portion, the engaging portion further including a second opening to receive either the first or second dimple regions of the electronic chassis door, the locking assembly further including a screw to attach the lock cam to the lock screw, the locking assembly further including a first washer received on the lock screw, and a second washer received on the screw of the locking assembly, the engaging portion including a beveled surface to interface with the first and second dimple regions of the electronic chassis door, the second opening of the lock cam including a beveled surface to interface with the first and second dimple regions of the electronic chassis door, wherein the first and second dimple regions of the electronic chassis door are oriented at 90 degrees with respect to the recessed region, wherein the stem portion and the head portion of the lock screw are integral with respect to each other, wherein the head portion of the lock screw receives an Allen-headed type screwdriver, wherein the recessed region is of a bowl-shaped divot, impressed within the electronic chassis door, wherein the locking assembly is rotatable 90 degrees between a locked position and an unlocked position, wherein the electronic chassis door contains a front window which is operatively attached to the electronic chassis door by a plurality of lens screws, and wherein the total overall depth of the electronic chassis door locking apparatus is less than 0.500 inches.

15. A method of operating an electronic chassis door locking apparatus, comprising:

providing an electronic chassis door including a recessed region formed therein, the recessed region positioned adjacent to a latch operatively attached to the electronic chassis door, the electronic chassis door further including a first raised dimple region formed between the recessed region and the latch and a second raised dimple region formed adjacent to the recessed region, and a locking assembly received in the recessed region, the locking assembly including a lock screw and a lock cam, the lock cam including an engaging portion and a first opening formed therein and, on the engaging portion of the lock cam, a second opening;

rotating the lock screw in a first direction;

rotating the lock cam in the first direction to engage the lock cam with the latch;

engaging the second opening of the lock cam with the first raised dimple region;

rotating the lock screw in a second direction;

rotating the lock cam in the second direction to disengage the lock cam from the latch;

disengaging the second opening of the lock cam from the first raised dimple region; and, engaging the second opening of the lock cam with the second raised dimple region.

* * * * *